United States Patent [19]

Biniasz et al.

[11] Patent Number: 4,687,525

[45] Date of Patent: Aug. 18, 1987

[54] WORKED LOW-TEMPERATURE TOUGH FERRITIC STEEL

[75] Inventors: Franz-Josef Biniasz; Bernhard Engl; Axel Füchs; Margit Hüser, all of Dortmund, Fed. Rep. of Germany

[73] Assignee: Hoesch Stahl AG, Fed. Rep. of Germany

[21] Appl. No.: 771,305

[22] Filed: Aug. 30, 1985

[30] Foreign Application Priority Data

Sep. 3, 1984 [DE] Fed. Rep. of Germany ..... 3432337

[51] Int. Cl.[4] ..... C22C 38/08

[52] U.S. Cl. ..... 148/336; 148/332

[58] Field of Search ..... 148/12 F, 12 E, 12 EA, 148/36, 336, 332; 420/119

[56] References Cited

U.S. PATENT DOCUMENTS 3,388,988 6/1968 Nagashima et al. ..... 148/12 F
3,834,949 9/1974 Heitmann et al. ..... 148/36

FOREIGN PATENT DOCUMENTS 56-33425 4/1981 Japan ..... 148/12 F
1116651 6/1965 United Kingdom ..... 148/36
1046333 10/1966 United Kingdom ..... 148/12 F

*Primary Examiner*—L. Dewayne Rutledge
*Assistant Examiner*—Deborah Yee

[57] ABSTRACT

The invention concerns a method for manufacturing a worked weldable, low temperature ferritic steel consisting of 0.015 to 0.08% C
0.1 to 0.5% Si
0.3 to 0.6% Mn
<0.015% P
<0.015% S
4 to 7% Ni
0 to 1.5% Cu the rest iron and unavoidable impurities in normal amounts which is characterized in that the steel has added to it 0.15 to 0.25% vanadian and 0.020 to 0.030% nitrogen; the steel being rolled and then cooled to room temperature and finally subjected to a one time normalizing. Such a steel is usable as work material for making construction part especially for the transport and storage of liquified natural gas and having at a temperature of −196° C. a notch charpy impact value at longitudinal test samples of more than 42 J.

5 Claims, 6 Drawing Figures

WORKED LOW-TEMPERATURE TOUGH FERRITIC STEEL

The invention concerns a method for manufacturing a weldable, low-temperature tough ferritic steel as well as its use.

With increasing demand for natural gas as an energy supply more tanker ships are required with containers which are suited to the transport of liquified natural gas (abbreviated LNG= liquified natural gas) safely to consuming lands. Along with LNG other liquified gases such as, for example, ammonia, aliphatic hydrocarbons or associated gases also come into question. Liquified gas can be economically transported since it takes on only a small portion of the volume of the gas at room temperature. Despite the complicated technology—requiring liquification and re-evaporating apparatus, transport containers on special ships and land vehicles, storage containers and so forth—the investment cost for such a LNG-chain amounts to only about one-tenth of the cost of an underwater pipeline.

The liquification of gases under atmospheric pressure occurs at their boiling temperatures. The boiling point of several technically important gases are given by the following table:

| Gas | Boiling Point in Degrees C. |
|---|---|
| Propane (LPG) | −42.3 |
| Carbon Dioxide | −78.5 |
| Acetylene | −83.6 |
| Ethane | −88.5 |
| Ethylene | −103.6 |
| Krypton | −153.4 |
| Methane (LNG) | −161.5 |
| Oxygen | −182.9 |
| Argon | −185.9 |
| Nitrogen | −195.8 |
| Neon | −246.1 |
| Hydrogen | −252.8 |
| Helium | −268.9 |

These boiling points represent the operating temperatures of the cryogenic apparatus which has to exhibit an adequate security against leaks and fractures. At the cryogenic temperatures usual steel alloys loose a great portion of their toughness and becomes very brittle; and for the construction of the mentioned apparatus low-temperature tough steels are accordingly required. Low-temperature tough steels are ferritic or austenitic construction steels which are characterized by especially good toughness properties up to very low operating temperatures. Such construction steels can be subjected to the usual working procedures such as cold forming, hot forming, thermal cutting and welding. In West Germany the choice of the kind of steel to be used for pressure container construction is standardized in the *AD-Specification W10—Work Material for Low Temperatures, Iron Materials.* The lowest allowable application temperature is dependent on the stress involved in the particular case.

In the case of LPG (liquified petroleum gas), the case of ethylene transport, and as well the case of transport and storage of LNG, ferritic construction steels come into use. Their area of use reaches to the operating temperature of liquid nitrogen at −196° C.

In the case of still lower operating temperatures, such as for example those which appear with liquid hydrogen or inert gases only austenitic steels which are higher alloyed as well as less strong, have been used up till now.

The most important alloying element for achieving sufficient toughness for ferritic construction steels at low temperatures is known to be nickel. It belongs to the elements which with iron form a complete solid solution. Through the use of nickel the $\gamma$-area is widened and the $A_3$ transformation point and the critical cooling speed are markedly reduced. With increasing nickel content the decline in toughness is shifted to lower temperatures. Up to a nickel content of about 5% the addition of each 1% nickel effects a decrease in the transition temperature of about 30° C., thereafter an improvement of about 10° C. results from each 1% nickel; that is, the addition of nickel is less effective. Accordingly, for an operating temperature up to −196° C. a steel with about 9% nickel is used.

Further known important measures for achieving a high toughness at low application temperatures are the reduction of carbon content and the increase of the manganese content to 2%. A reduction of sulfur and phosphorous content also is known to likewise have a beneficial effect on the toughness properties.

For the main application of ferritic construction steel, the transport and the storage of liquified natural gas, the 9% nickel steel X8Ni9 is especially used. In the area of the boiling point of methane (−161.5° C. ) this material exhibits considerable toughness reserves; its useful area reaches to the temperature of liquid nitrogen (−196° C.).

Low alloyed steels in general are normalized to obtain a uniform fine grain size and accordingly good mechanical properties and toughness. The steel X8Ni9 with a composition of max 0.10% C, max 0.35% Si, 0.30–0.80% Mn, max 0.025% P, max 0.020% S, min 0.015% Al and 8.5–10%Ni, in accordance with Euronorn 129-76, and as the choice of the manufacturer, is either water-quenched and tempered by being quenched from 780° C.–820° C.

tempered at 560° C.–600° C.

or air-cooled and tempered, by 1. normalizing at 780° C.–820° C.
2. normalizing at 780° C.–820° C.
   tempering at 560° C.–600° C.

During the first mentioned as well as during the second mentioned heat treatment a structure of tempered martensite with a certain quantity of finely dispersed austenite is aimed for.

The aforementioned temperature areas are viewed as optimal for achieving the work material properties claimed according to Euronorm 129-76:

| Re N/mm² | Rm N/mm² | $A_5$ % | Cv at −196° C.[1] in J longitudinal | Cv at −196° C.[1] in J transverse |
|---|---|---|---|---|
| ≧480 | 640–840 | ≧18 | ≧42 | ≧27 |

[1]Cv = Charpy value

In this table Re means the yield strength, Rm the tensile strength, $A_5$ elongation at fracture of a short proportional bar, and Cv the notch impact energy.

The nickel content delivers a considerable contribution in respect to good low temperature properties. Nickel is however a relatively scarce metal. As shown by recent publications, because of cost strides should be made to save nickel by alloying technique measures and by special heat treatments.

Despite considerable laboratory investigations the only technically proven further development of steel 12Ni19 seems to be of steel X7NiMo6, compare Bander, Bleche, Rohre 2-1975, pages 48–52.

By an increase in the nickel content to 5.5%, the Mn content from about 0.6 to 1.2% and by the alloying of about 0.2% molybdenum, as well as by a relatively complicated three step heat treatment, a microstructure is achieved in this steel which is similar to that of X8Ni9. This work material at −160° exhibits a V-notch Charpy impact value of at least 43 J at longitudinal test samples and of more than 27 J at transverse test samples. This steel nevertheless represents no complete substitute for steel X8Ni9.

Attempts have also been made to replace nickel with manganese. In DE-OS3030652 a low-temperature tough ferritic steel is identified which contains essentially 0.02–0.06% carbon, 4%–6% manganese, 0.1–0.4% molybdenum and 0–3% nickel and which is subjected to a complex thermal-cyclic treatment. As a result of four tempering treatments essentially a repeated change of the austenitizing and of the $(\alpha+\gamma)$—two phase dissaciation is achieved. Finally, after the thermal-cyclic process there follows a three to sixteen hour tempering treatment at temperatures from 540° C. to 600° C. The aforementioned thermal-cyclic heat treatment is supposed to produce an "ultra-fine" microstructure whereby a transition temperature below that of liquid nitrogen (−196° C.) and a Charpy V-notch impact energy $C_V$ of more than 67 J at −196° C. are achieved. Statements about the weldability of this known steel have not been made, so that it can be assumed that through a welding of it the achieved "ultra-fine" microstructure is raised and as a consequence the toughness properties in the area of the weld can be considerably worsened.

The invention has as its object the provision of a weldable low-temperature tough ferritic steel which with a lowered nickel content, with respect to that of the known low temperature steel X8NI9, is especially suited for cryogenic use, particularly with LNG, and at operating temperatures up to −196° C. exhibits a sufficient security against brittle failures, and which moreover is made in a simple way.

BRIEF DESCRIPTION OF THE DRAWINGS

To better appreciate how the present invention meets the object of providing a weldable low temperature tough ferritic steel with a low nickel content, the following drawings will be helpful, in which.

For the solution of this object basic investigations were made first of all on steels with a basic composition of 0.04% C, 0.30% Si, 0.40% Mn, 0.007% P and 0.005% S as to the influence of vanadium and nitrogen on the microstructure and low temperature properties of rolled and subsequently normalized steels with 1 to 9% nickel.

Figure 1:
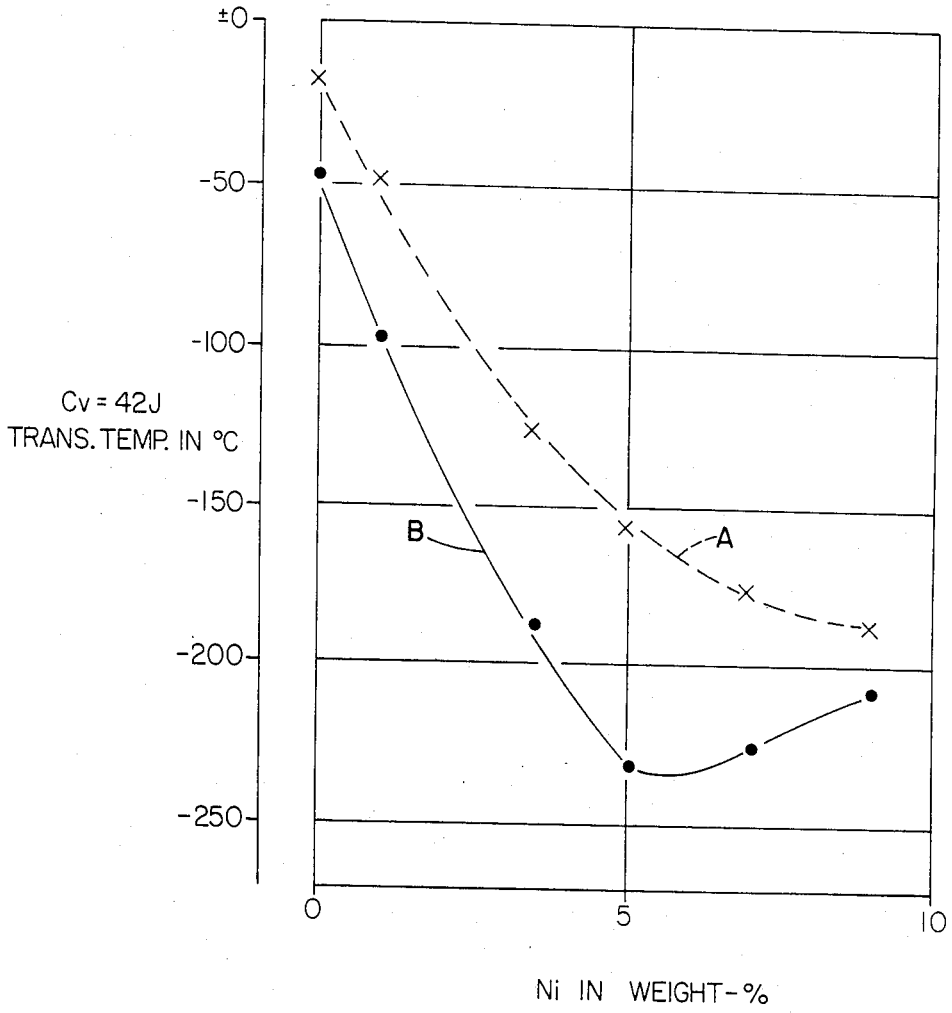
FIG. 1 is a graph illustrating the dependency of the transition temperature on nickel content and the influence of vanadium-nitrogen alloying on this dependency for steels with a basic content of 0.04% C, 0.30% Si, 0.40% Mn, 0.007% P and 0.005% S.

FIG. 1 illustrates the dependency of the transition temperature on the nickel content as well as the influence of the V-N alloying on the transition temperature with corresponding nickel content.

Curve A shows the dependency of low temperature toughness on nickel content. The known improvement of the low temperature toughness with increasing nickel content is seen, the effectiveness diminishing at about 5% nickel. By the addition from 0.15 to 0.25% V and 0.020 to 0.030% N the transition temperature of the steel is considerably reduced. Curve B makes evident that no additive improvement appears with respect to steel without V and N, but the difference in the transition temperature increases with increasing nickel content, at 5 to 6% nickel a maximum is reached, and above about 6% nickel again diminishes. Therefore, in manufacturing a steel the largest possible effect on increasing the low temperature toughness through vanadium and nitrogen, and at the same time the lowest transition temperature is achieved, if the steel contains 5 to 6% nickel.

According to these basic findings the object of the invention is solved by a method for manufacturing a weldable, low-temperature tough ferritic steel with a composition of 0.015 to 0.08% C
0.1 to 0.5% Si
0.3 to 0.6% Mn
<0.015% P
<0.015% S
4 to 7% Ni
the rest iron and unavoidable impurities, characterized further by
0.15 to 0.25% Vanadium and
0.020 to 0.030% Nitrogen
added to the steel, the steel after rolling being cooled to room temperature and finally subjected to a one time normalizing. According to a preferred embodiment the steel contains additionally 0.5 to 1.5% copper. In furtherance of the invention the steel is prerolled at a conventional rolling reduction, per pass preferably about 25%, is cooled in a rolling interruption to 840° C. to 900° C., then is finished rolled to sheet thickness at a rolling temperature from 770° C.–820° C., is cooled to room temperature and finally is subjected to a one time normalizing.

Further an essential part of the invention is the use of such a manufactured and constituted weldable, low-temperature tough ferritic steel as the material for making parts to be used at low temperatures which steel has a reduced nickel content, preferably a 4 to 7% nickel content, and still more preferably a 5 to 6% nickel content, by utilizing the largest possible effect of the vanadium and the nitrogen and having a structure of very fine grained ferrite with included bainite and martensite islands, and which material at a temperature of −196° C. exhibits a V-notch Charpy impact value at longitudinal test samples of more than 42 J, the parts involved for example being ones such as are usable for the transport and storage of liquified natural gas.

Collectively, the advantages of the invention are to be seen in that the excellent properties of the new steel are achieved through the cooperation of nickel; vanadium and nitrogen with the further alloying elements, as well as in a simplified manufacturing procedure, whereby a work material is successfully developed, at comparatively low raw material cost and finishing cost, which is preeminantly suited to primary cryogenic applications involving LNG and which at operating temperatures up to −196° C. exhibits a sufficient security against failures due to brittleness.

The invention is explained in more detail hereinafter in connection with the following examples.

EXAMPLE 1

A steel with a chemical composition of
0.07% C
0.27% Si
0.58% Mn
0.006% P
0.005% S
0.16% V
0.024% N
5.6% Ni,
the rest iron and unavoidable impurities was prerolled ata conventional rolling reduction of 25% per pass. In an interruption of the rolling it was cooled to about 850° C., and then it was finished rolled to sheet thickness at a rolling temperature of about 780° C. It was then cooled to room temperature and finally normallized one time (790° C., 30 min/cooling 80° C./min=air cooling at 24 mm sheet).

Figure 2:
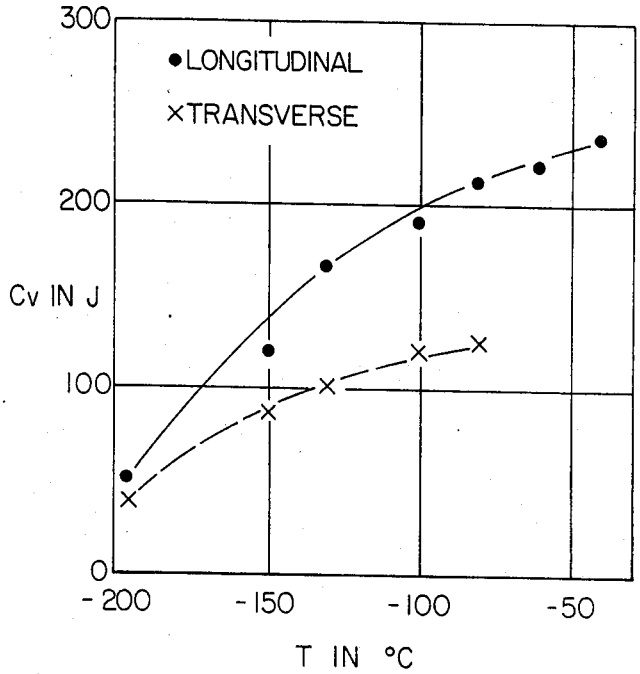
FIG. 2 is a graph illustrating the relationship between the Charpy impact value and temperature for the preferred embodiment of the invention disclosed in example 1.

As shown by the Cv-T curves of FIG. 2, this steel exhibits at −196° C. a V-notch Charpy impact value of 52 J at longitudinal test samples and of 36 J at the transverse test samples. The steel at room temperature has a yield strength of 546 N/mm$^2$, tensile strength of 673 N/mm$^2$ and an elongation of 29.7%. The properties required by Euronorm 129-76 for material X8Ni9 are therefore completely achieved.

EXAMPLE 2

A steel with a chemical composition of
0.04% C
0.31% Si
0.36% Mn
0.006% P
0.005% S
0.25% V
0.028% N
5.2% Ni
was rolled and normalized in the same way as in Example 1.

Figure 3:
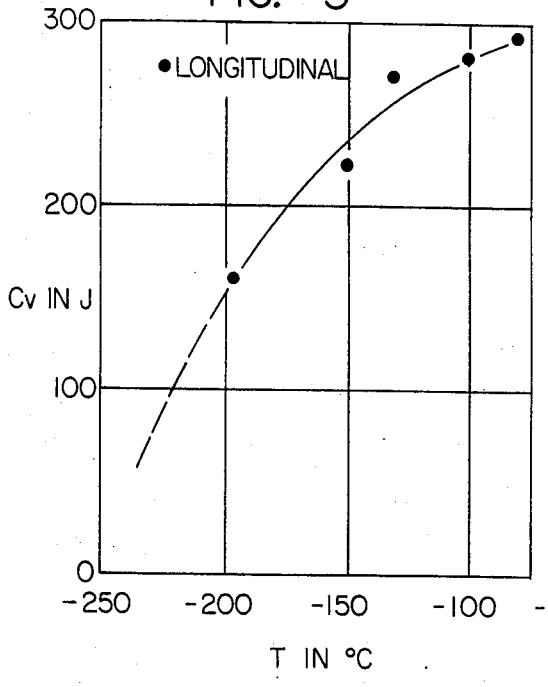
FIG. 3 is a graph illustrating the relationship between the Charpy impact value and temperature for the preferred embodiment of the invention disclosed in example 2.

From the Cv-T curve in FIG. 3 it can be seen that the steel has an excellent low temperature toughness.

In the following table the mechanical-technological test values are given.

| Re N/mm$^2$ | Rm N/mm$^2$ | $A_5$ % | $C_v$ at −196° C. in J longitudinal |
|---|---|---|---|
| 548 | 621 | 30.9 | 159 |

Despite the lowered tensile strength in comparison to Example 1, the high yield strength of this steel permits a weight saving construction. From the $C_v$−T curve in FIG. 3 it can be derived that the steel itself at −230° C. is still tough and in case of being used with LNG exhibits considerable toughness reserve with a toughness of 200 J.

EXAMPLE 3

A steel with a chemical composition of
0.037% C
0.34% Si
0.36% Mn
0.005% P
0.005% S
0.26% V
0.029% N
5.8% Ni
was rolled in the same way as in Example 1, subsequently was heated to 790° C. and then cooled in water. As shown by the following test values this treatment produced a considerable increase in the yield strength and tensile strength.

With a sufficient toughness of $C_v$ equals 70 J at V-notch Charpy longitudinal test samples at −196° C., the steel exhibits a yield strength of 623 N/mm$^2$, a tensile strength of 788 N/mm$^2$ and an elongation of 22.5%.

EXAMPLE 4

Low-temperature tough steel according to its use, is more or less heavily cold formed. Since a heavy cold forming produces a large loss of toughness, this effect must be overcome by a stress relieving anneal at a temperature of 530° C. to 580° C. To check on its suitability the steel of Example 3 was annealed at 530° C.

As shown by the following test values such a stress relieving anneal has no degrading effect on the toughness properties of this steel.

| Re N/mm$^2$ | Rm N/mm$^2$ | $A_5$ % | $C^v$ at −196° C. in J Longitudinal |
|---|---|---|---|
| 634 | 699 | 25.7 | 66 |

EXAMPLE 5

A further possibility for increasing the yield strength and tensile strength exists in alloying the work material with copper.

A steel with a chemical composition of
0.038% C
0.27% Si
0.57% Mn
0.007% P
0.005% S
0.15% V
0.024% N
5.4% Ni
1.05% Cu
was rolled and normalized as in Example 1.

Figure 4:
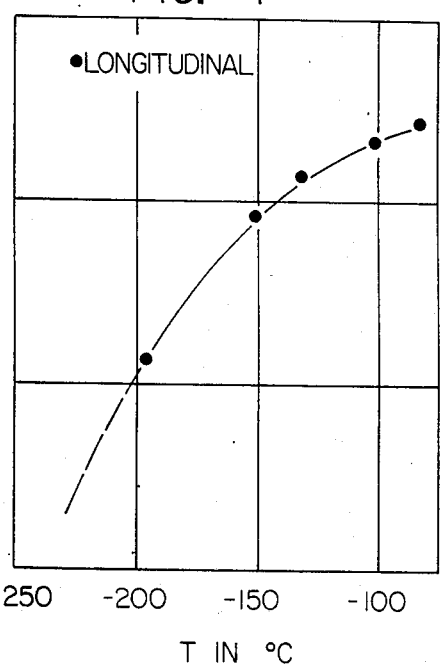
FIG. 4 is a graph illustrating the relationship between the Charpy impact value and temperature for the preferred embodiment of the invention disclosed in example 5.

As shown by the $C_v$—T curve in FIG. 4 this steel exhibits outstanding toughness properties. It has a yield strength of 591 N/mm$^2$, a tensile strength of 666 N/mm$^2$ and an elongation of 29.2%. The Charpy-value at −196° C. amounts to 116 J (longitudinal test samples).

Figure 5:
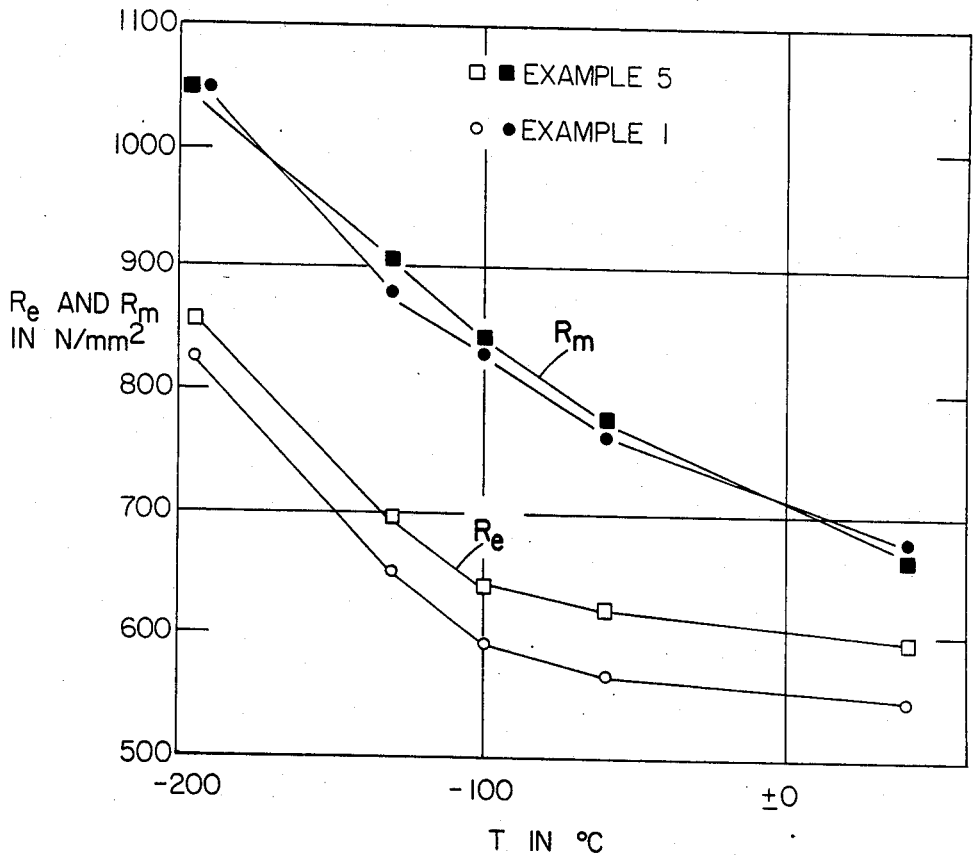
FIG. 5 is a graph illustrating the relationship between the yield strength and temperature and the relationship between the tensile strength and temperature for the example 1 and example 5 preferred embodiments of the invention.

The material criteria for X8Ni9 steel are likewise entirely fulfilled with this work material. In FIG. 5 the strength properties of the steel and the steel of Example 1 are represented in dependence on the test temperature. It is to be seen that at −196° C. the yield strength values are 825 or 850 N/mm$^2$ and the tensile strength values are 1045 N/mm$^2$.

EXAMPLE 6

Figure 6:
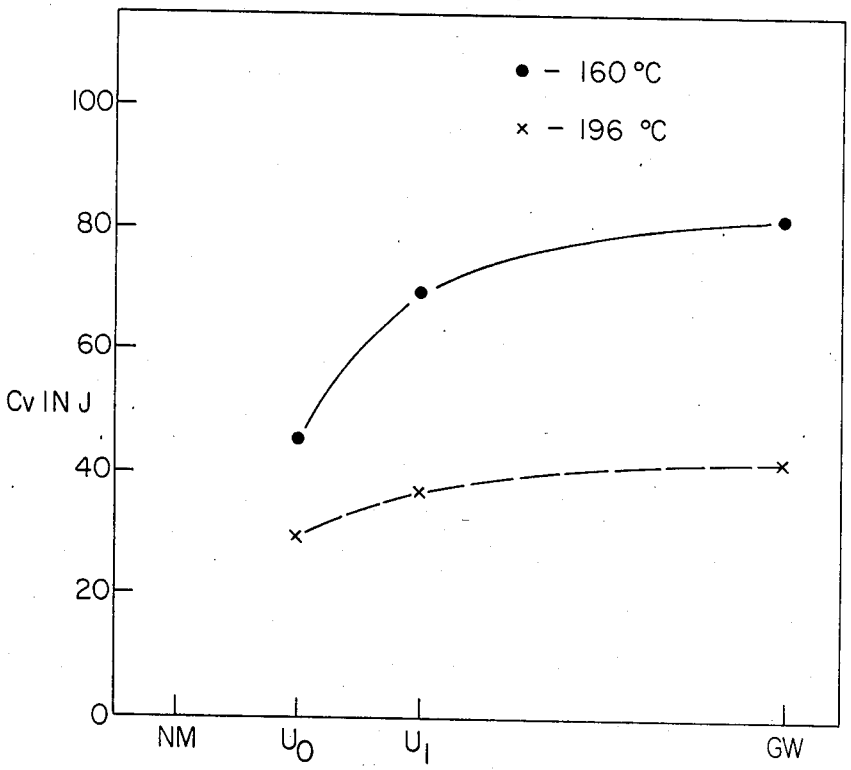
FIG. 6 is a graph illustrating the relationship between the Charpy impact value and distance from the fusion line inside the heat effected zone of the example 1 preferred embodiment of the invention.
Figure 6:
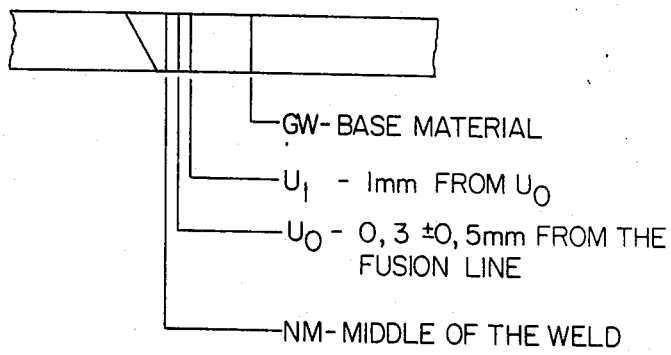

For testing its weldability the steel of Example 1 with high C and Mn content was called upon. For the welding an austenitic filler material was used. No cracks at all were observed in the weld connection. Tests of the notch impact strength were carried out at V-notch Charpy impact test samples (transverse to the rolling direction) at −160° C. and −196° C. Special attention was given to the heat affected zone, since at that place a decrease in toughness always has to be expected. On that account the notch of the Charpy impact test samples was arranged in a defined spacing from the fusion line inside the heat affected zone as explained in the lower part of FIG. 6. The lowest toughness value was shown by the area $U_o$ of FIG. 6 spaced about 0.5 mm from the fusion line. At a test temperature of −160° C. the toughness of this zone nevertheless had a value of 46 J and at −196° C. had a value of 30 J (transverse test samples). The given requirements were therefore fulfilled.

With still further reduced C and Mn content, as in Example 2, still better toughness properties are to be expected in the critical heat affected zone.

We claim:

1. A worked, weldable, low temperature tough, ferritic steel consisting of 0.015 to 0.08% C
0.1 to 0.5% Si
0.3 to 0.6% Mn
<0.015% P
<0.015% S
4 to 7% Ni
0.15 to 0.25% V
0.020 to 0.030% N
0 to 1.5% Cu the rest iron and unavoidable impurities in normal amounts, said worked steel suitable for construction parts to be used at low temperatures, said steel having a nickel content reduced in comparison to that of the known steel X8Ni9.

2. A worked weldable, low temperature ferritic steel with a composition according to claim 1 exhibiting a structure of very fine grain ferrite with included bainite and martensite islands, said worked steel suitable for construction parts which material at a temperature of −196° C. has a V-notch Charpy impact value at longitudinal test samples of more than 42 J and at this temperature has a sufficient tensile strength allowing it to be used for the transport and the storage of liquified natural gas.

3. A worked weldable, low temperature ferritic steel consisting of 0.015to 0.08% C
0.1 to 0.5% Si
0.3 to 0.6% Mn
<0.015% P
<0.015% S
5 to 6% Ni
0.15 to 0.25% V
0.020 to 0.030% N the rest iron and unavoidable impurities in normal amounts, said worked steel suitable for making construction parts for use at low temperatures.

4. A worked weldable low-temperature tough, ferritic steel with a composition according to claim 3 exhibiting a structure of very fine grain ferrite with included bainite and martensite islands, said worked steel suitable for construction parts which at a temperature of −196° C. has a V-notch Charpy impact value at longitudinal test samples of more than 42 J and at this temperature has a sufficient tensile strength allowing it to be used for the transport and the storage of liquified natural gas.

5. A worked, weldable, low temperature-tough ferritic steel consisting of:

0.015 to 0.08% C
0.1 to 0.5% Si
0.3 to 0.6% Mn
<0.015% P
<0.015% S
4 to 7% Ni
0.15 to 0.25% V
0.020 to 0.030% N
0.5 to 1.5% Cu the rest iron and unavoidable impurities in normal amounts, said worked steel suitable for construction parts to be used at low temperatures, said steel having a nickel content reduced in comparison to that of the known steel X8Ni9.

* * * * *